United States Patent [19]

Althoff et al.

[11] 4,168,208

[45] Sep. 18, 1979

[54] ASCENSION PIPE CLOSURE FOR COKE OVEN BATTERIES

[75] Inventors: Ludger Althoff, Haltern; Theo Koddenberg, Bochum, both of Fed. Rep. of Germany; Franz-Josef Rottstegge, Arenzano, Italy

[73] Assignee: Dr. C. Otto & Comp. G.m.b.H., Bochum, Fed. Rep. of Germany

[21] Appl. No.: 837,962

[22] Filed: Sep. 29, 1977

[30] Foreign Application Priority Data

Jun. 29, 1977 [DE] Fed. Rep. of Germany ..... 2729316

[51] Int. Cl.[2] ..... C10B 27/06; C10B 29/00

[52] U.S. Cl. ..... 202/254; 202/269

[58] Field of Search ..... 202/243, 254–261, 202/242, 269, 270; 196/136; 266/159

[56] References Cited

U.S. PATENT DOCUMENTS

| | | | |
|---|---|---|---|
| 416,855 | 12/1889 | Prindle | 202/242 |
| 2,920,017 | 1/1960 | Limberg | 202/242 |

FOREIGN PATENT DOCUMENTS

| | | | |
|---|---|---|---|
| 533322 | 11/1956 | Canada | 202/254 |
| 319888 | 4/1920 | Fed. Rep. of Germany | 202/254 |
| 536053 | 10/1931 | Fed. Rep. of Germany | 202/260 |
| 165581 | 7/1921 | United Kingdom | 202/254 |
| 373092 | 5/1932 | United Kingdom | 202/254 |

*Primary Examiner*—Morris O. Wolk
*Assistant Examiner*—Bradley Garris
*Attorney, Agent, or Firm*—Thomas H. Murray; Clifford A. Poff

[57] ABSTRACT

An elbow cover for a coke oven ascension pipe characterized in that the opening which is covered is oval in shape and is formed at the junction of the ascension pipe and a downwardly-extending supply pipe leading to a gas-collecting main. The oval-shaped cover is provided with an immersion cup seal and a spaced sealing plate. Because of the oval shape of the opening, cleaning tools can be readily inserted into the opening to clean both the ascension pipe as well as the supply pipe.

4 Claims, 5 Drawing Figures

ASCENSION PIPE CLOSURE FOR COKE OVEN BATTERIES

BACKGROUND OF THE INVENTION

As is known, coke ovens may be equipped with one or two offtakes to carry away the volatile products liberated in the coking process. The volatile products pass through a duct in the oven top and enter a refractory lined standpipe, usually called an "ascension pipe," which is connected through a supply pipe to a gas-collecting main. Steam and water are injected into the supply pipe to clean the issuing gases prior to the time that they enter the gas-collecting main. A liquid-sealed valve is provided in the supply pipe, the liquid therefor being derived from the water and steam sprayed onto the issuing gases. At the junction of the top of the ascension pipe and the downwardly-extending supply pipe is a cap valve or "elbow cover" which, when open, vents the oven to the atmosphere. The cover is removed from the ascension pipe while the oven is charged and during the coke pushing operation of the battery.

Prior art elbow covers of this type normally could be opened to permit a cleaning device to be inserted through the opening in the ascension pipe to clean the supply pipe; however, since the opening in the ascension pipe was normally circular in configuration, difficulties were sometimes encountered in manipulating the cleaning device. Furthermore, in prior art elbow covers, tar deposits collect on the inner surface of the cover which burn when the cover is opened, causing pollution of the atmosphere.

SUMMARY OF THE INVENTION

In accordance with the present invention, an opening is provided at the top of a coke oven ascension pipe, and a novel elbow cover is provided therefor, which enables easy insertion of a cleaning device for both the ascension pipe as well as the supply pipe leading to the gas-collecting main and which avoids as far as possible any pollution of the environment when the coke is pushed out of the batteries as well as during cleaning operations.

Specifically, there is provided a cylindrical ascension pipe leading from the top of a coke oven chamber and a downwardly-extending supply pipe connected to the top of the ascension pipe at the side thereof for conveying gases from the ascension pipe to a gas-collecting main. The junction of the ascension and supply pipes from a generally oval opening at the upper extremities thereof; while a pivotal oval-shaped elbow cover selectively closes the oval opening.

The elbow cover is preferably provided with an immersion cup seal around its periphery, the seal comprising a flange on the cover which extends into a peripheral trough around the oval opening. Water is continuously circulated through the trough. The water which circulates through the trough can, for example, be obtained from the collecting tank for coke quenching and can be returned thereto.

Further, in accordance with the invention, the oval elbow cover comprises an outer lid or top and an inner steel plate, the two being separated by spacers to form an insulating air space between the two. The inner steel plate abuts in sealing engagement with the periphery of the oval opening with the result that the formation of tar condensates on the cover is reduced, both on the inner steel plate as well as the surrounding immersion seal. This substantially simplifies maintenance operations and to a substantial degree reduces pollution of the environment. Such pollution occurs to a large extent if substantial amounts of tar condensates are formed on the elbow cover and are burned off when the cover is open.

The above and other objects and features of the invention will become apparent from the following detailed description taken in connection with the accompanying drawings which form a part of this specification, and in which.

Figure 1:
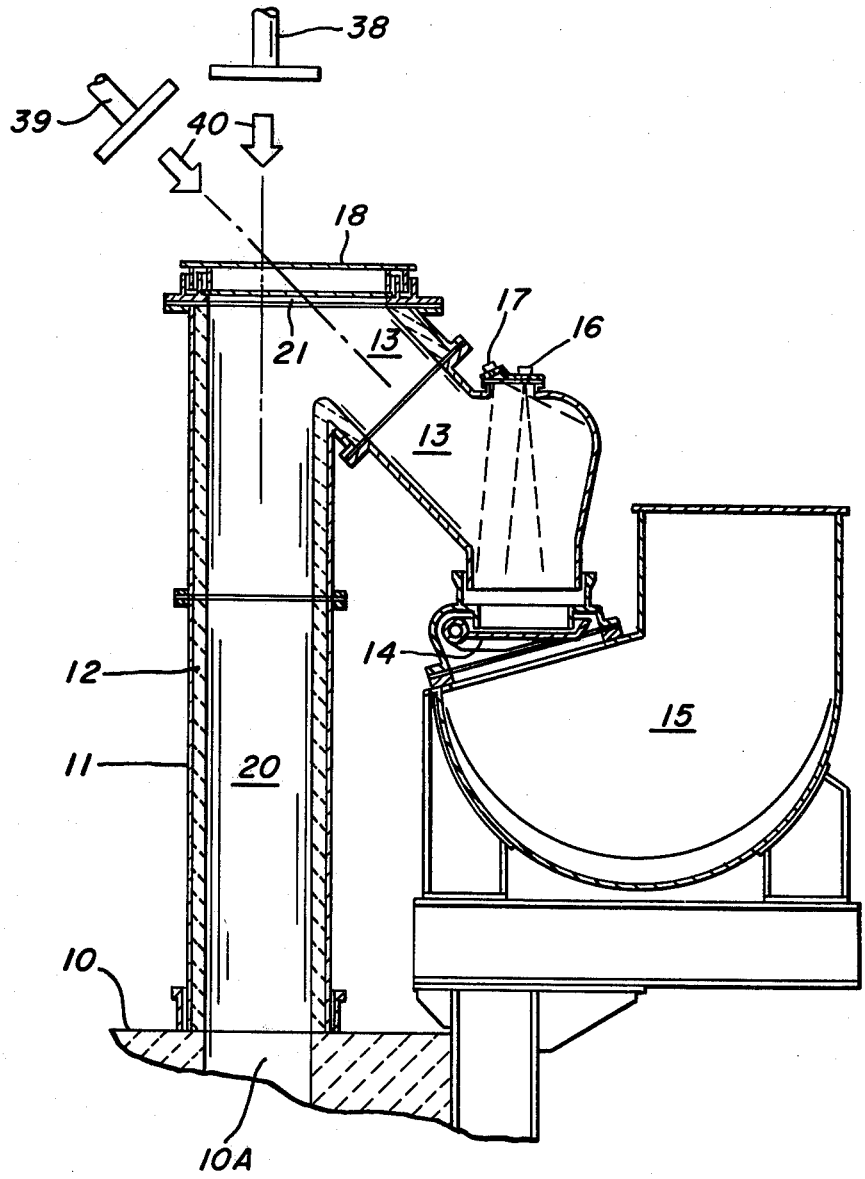
FIG. 1 is a vertical cross-sectional view showing an ascension pipe, a downwardly-extending supply pipe and a collecting main, the junction of the ascension and supply pipes being covered by the elbow cover of the invention.

With reference now to the drawings, and particularly to FIG. 1, the numeral 10 denotes the top of a coke oven having an opening 10A communicating with an ascension pipe 20 which carries away the volatile products produced during the coking process. The ascension pipe 20 comprises an outer metallic shell 11 having an inner refractory lining 12. At its upper extremity, the ascension pipe 20 is connected to a downwardly-directed supply pipe 13. In the particular embodiment of the invention shown herein, the supply pipe 13 is disposed at an angle of 45° with respect to the vertical axis of the ascension pipe 20. At the bottom of the supply pipe 13 is a liquid-sealed valve 14 of the immersion type. A steam nozzle 16 and a water nozzle 17 are situated in the supply pipe 13 and spray the products of combustion passing therethrough. Water from the nozzles 16 and 17 forms a seal in the immersion-type seal 14. On the downward side of the seal 14 is the gas-collecting main 15, the interior of which is maintained at a negative pressure by a suitable blower or the like, not shown.

Figure 3:
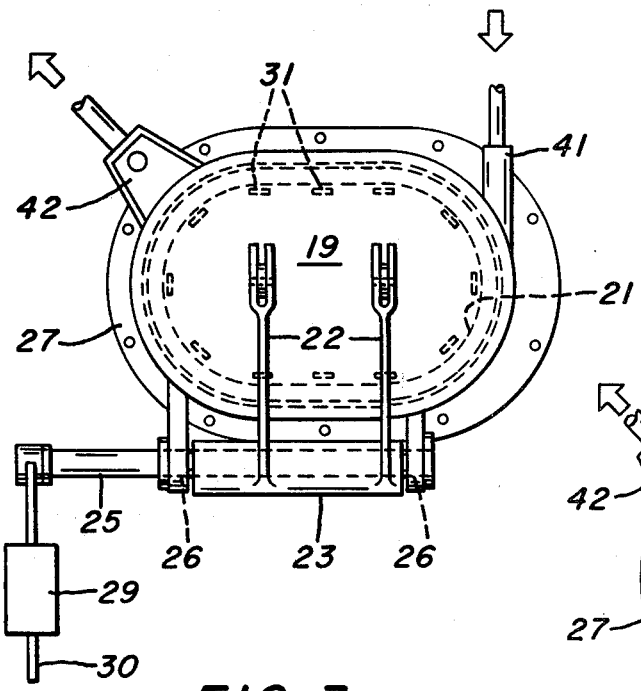
FIG. 3 is a top view of the elbow cover of FIG. 2.

The ascension pipe 20 and the supply pipe 13 converge and form an oval opening 21, the configuration of which is perhaps best shown in FIG. 3. The oval opening 21 is covered by an elbow cover 18 which is also oval in shape. When the cover 18 is removed, cleaning tools 38 or 39 (FIG. 1) carried on the charging car, for example, can be readily inserted into the ascension pipe 20 as well as the supply pipe 13 to clean the same along the direction of arrows 40. In this regard, it will be appreciated that by virtue of the fact that the opening 21 is oval in shape, either cleaning tool may be inserted into the pipe 20 or 13 with a minimum of manipulation.

Figure 2:
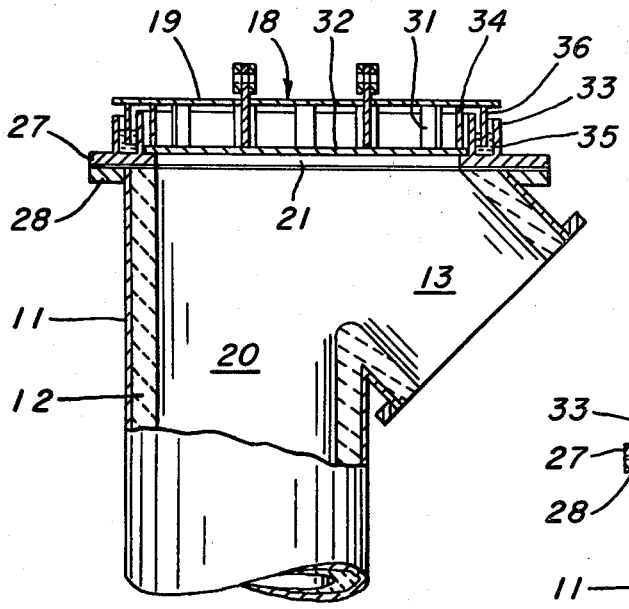
FIG. 2 is an enlarged vertical cross-sectional view showing the details of the elbow cover of the invention.

One embodiment of the elbow cover, sealed by a water pocket seal in addition to an iron-on-iron seal, is shown in FIGS. 2 and 3. The oval top 19 of the cover is connected through arms 22 to a tubular sleeve 23 provided with a square bore or the like into which an end of shaft 25 is inserted. The shaft is supported on bearings 26 carried on an annular plate 27 which is bolted to a flange 28 secured to the top of the outer shell 11 of ascension pipe 20. A counterweight 29 and operating lever 30 are secured to the end of shaft 25 such that upon downward movement of the arm 30, the cover 18 will be elevated from the oval opening 21.

The cover 18 itself comprises a lower steel plate 32 which abuts against the flange 27 extending around the periphery of the opening 21. The plate 32 is welded to the bottoms of webs or spacers 31 extending between the plate 32 and the top 19 of the cover, thereby providing an insulating air space between the top 19 and the plate 32.

Extending upwardly from the flange 27 are peripheral flanges 33 and 34 which form a water pocket or trough 35. Extending downwardly into the water within the trough 35 is a flange 36 secured to the underside of the top 19. Thus, an effective water seal is provided between the interior of the pipes 20 and 13 and the atmosphere during a coking operation. In FIG. 3, the numeral 41 refers to a water supply pipe; while the numeral 42 identifies a water discharge pipe for water which flows through the trough 35. The water for trough 35 can be obtained from the collecting tank for coke quenching and can be returned thereto.

Figure 4:
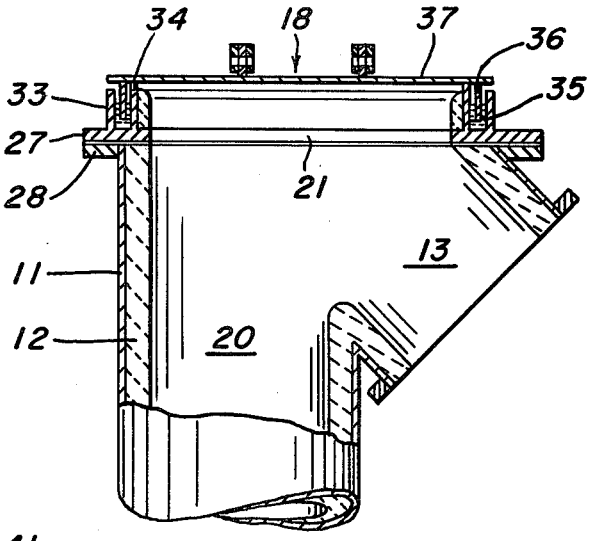
FIG. 4 is a vertical cross-sectional view of another embodiment of the elbow cover of the invention.
Figure 5:
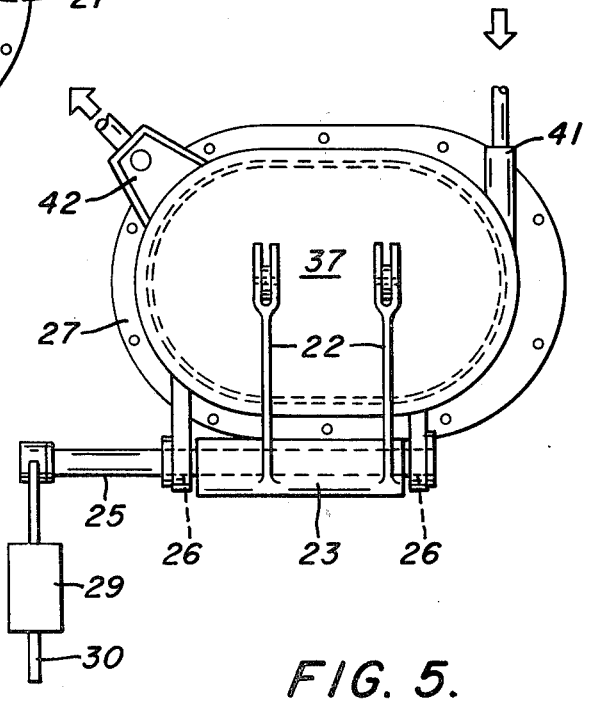
FIG. 5 is a top view of the alternative embodiment of FIG. 4.

The embodiment of the invention shown in FIGS. 4 and 5 is similar to that of FIGS. 2 and 3 except that the lower steel plate 32 is eliminated and the closure is formed merely by means of the flange 36 which extends into the trough 35. The remainder of the assembly, however, is the same, with elements in FIGS. 4 and 5 corresponding to those of FIGS. 2 and 3 being identified by like reference numerals.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a coke oven battery including coke oven chambers, a cylindrical ascension pipe above the top of the coke oven battery to conduct volatile products produced during the coking process in each of said coke oven chambers, a gas-collecting main extending along the top of said coke oven battery a supply pipe connected to the top of said ascension pipe at the side thereof to extend downwardly at an angle about 45° for conveying gases from the ascension pipe to said gas-collecting main, the junction of the ascension and supply pipes forming an opening at the upper extremities thereof, a pivotal elbow cover having an immersion water seal to selectively close said opening, said cover including a top portion spaced from said opening, a plate in sealing engagement with said opening beneath the top portion of said cover, and spacers extending between said plate and the top portion of said cover to provide an airspace between the two, said immersion seal comprising a water trough extending around the periphery of said opening together with a downwardly-depending flange secured to the underside of said top portion which extends into said trough outwardly of said plate, and means for supplying water to said trough.

2. The combination of claim 1 wherein said opening lies in a generally horizontal plane.

3. The combination of claim 1 wherein said cover is connected by arms to a pivotal shaft secured to the upper end of the ascension pipe.

4. The combination according to claim 1 wherein a generally oval-shaped configuration defines each of said elbow cover and said opening at the junction of the ascension and supply pipes.

* * * * *